US008002204B2

(12) United States Patent
Paul et al.

(10) Patent No.: US 8,002,204 B2
(45) **Date of Patent: *Aug. 23, 2011**

(54) DECOKING TOOL

(75) Inventors: Wolfgang Paul, Bad Schwartau (DE); Dirk Heidemann, Schwerte (DE); Kay Simon, Iserlohn (DE); Maciej Barcikowski, Bochum (DE); Thomas Graefenstein, Dortmund (DE); Steffen Krenzer, Bochum (DE)

(73) Assignee: Ruhrpumpen GmbH, Witten (DE)

( * ) Notice: Subject to any disclaimer, the term of this patent is extended or adjusted under 35 U.S.C. 154(b) by 743 days.

This patent is subject to a terminal disclaimer.

(21) Appl. No.: 11/967,312

(22) Filed: Dec. 31, 2007

(65) Prior Publication Data

US 2009/0165617 A1 Jul. 2, 2009

(51) Int. Cl.
*A62C 31/00* (2006.01)

(52) U.S. Cl. ..... 239/443; 239/444; 239/447; 239/442; 83/177

(58) Field of Classification Search ..... 239/442, 239/443, 444, 447, 436, 437, 312, 445; 83/177; 299/81.3; 137/624.13, 624.18
See application file for complete search history.

(56) References Cited

U.S. PATENT DOCUMENTS

| | | | | |
|---|---|---|---|---|
| 2,294,719 | A * | 9/1942 | Frederick | 239/244 |
| 2,538,211 | A * | 1/1951 | Prout | 239/446 |
| 3,941,953 | A | 3/1976 | Mission et al. | |
| 4,275,842 | A * | 6/1981 | Purton et al. | 239/446 |
| 4,738,399 | A * | 4/1988 | Adams | 239/447 |
| 4,923,021 | A * | 5/1990 | Courmier et al. | 175/382 |
| 5,816,505 | A * | 10/1998 | Tran et al. | 239/443 |
| 6,050,277 | A * | 4/2000 | Purton et al. | 134/167 R |
| 6,644,567 | B1 * | 11/2003 | Adams et al. | 239/566 |
| 7,117,959 | B2 * | 10/2006 | Lah | 175/67 |
| 7,473,337 | B2 * | 1/2009 | Lah | 202/239 |
| 2009/0165618 | A1 * | 7/2009 | Paul et al. | 83/177 |

FOREIGN PATENT DOCUMENTS

| | | |
|---|---|---|
| DE | 39 41 953 C2 | 6/2002 |
| DE | 103 92 866 | 6/2006 |
| SU | 1059883 | 2/1985 |
| SU | 1 120 693 | 5/1985 |
| WO | 2005/105953 A1 | 11/2005 |

* cited by examiner

*Primary Examiner* — Len Tran
*Assistant Examiner* — Trevor E McGraw
(74) *Attorney, Agent, or Firm* — Luedeka, Neely & Graham, P.C.

(57) ABSTRACT

A tool for cutting up coke in containers. The tool includes a housing mounted on a drill stem in the operating condition. The tool also includes at least one cutting nozzle for cutting and a boring nozzle for boring coke by means of a water jet, and a switching apparatus for controlling the feeding of pressurized water flowing through the drill stem and the housing. The switching apparatus includes a linearly moveable switching element, a driving apparatus and a control apparatus, which is rotatable as a function of a change of the water pressure by the driving apparatus to switch a valve to distribute the water and to pass it on. The angular position of the control apparatus controls whether the flow path of the water to the boring nozzle or the flow path to the cutting nozzle is free or obstructed.

16 Claims, 10 Drawing Sheets

DECOKING TOOL

BACKGROUND OF THE INVENTION

In oil refineries, the last, unusable fraction of crude oil is converted into coke. The conversion is carried out by conducting this fraction into upright drums having considerable capacity and having a height of about 40 m, for example, and having a diameter of, for example, 8 m. The drums are filled with coke over the operating duration. Once the maximum capacity of a drum is reached, the coke is cut out from the drum. This process referred to as "decoking" is carried out with high-pressure water jets which break up the coke in the drum and flush it out of the drum. A tool for generating the high-pressure water jets is mounted on a drill stem supplied with water under high pressure, and is introduced together with the drill stem into the drum from above. First, the tool is used to bore a continuous coaxial hole from the top to the bottom, wherein the high-pressure water jets exit from boring nozzles usually arranged at the lower end of the tool for breaking up the coke. Then the tool together with the drill stem is lifted up again to the upper end of the drum. There the tool is switched from the boring function to the cutting function by obstructing the flow path of the pressurized water to the boring nozzles and freeing instead the flow path to the cutting nozzles circumferentially arranged on the tool and from which the high-pressure water jets exit in a direction essentially transverse to the longitudinal axis of the tool and the drill stem, and break up the coke across the cross section of the drum in a spiraling path. This is because the tool with the drill stem executes a rotary motion during boring and during cutting of the coke. The coke broken up in this manner is flushed out from the bottom of the drum.

A tool known from WO 2005/105953 A1 (RUHRPUMPEN) of the initially mentioned type, in a housing provided with boring and cutting nozzles, comprises an essentially cylindrical flow body having four flow channels extending though it, the top openings of which are closable in pairs by two disk-shaped closure bodies of a valve means. The valve means is arranged in a flow channel having water supplied to it under high pressure from a drill stem when the tool is in operation, the tool being mounted on the drill stem by a flange enclosing a supply channel. When the tool is operated, water under a high operating pressure flows into the tool and, depending on each switching position of a control apparatus linking a switching apparatus with the valve means, is directed either through the flow channels and an adjacent expansion to the boring nozzles or through corresponding flow channels to the cutting nozzles and used there for boring or cutting the coke material.

To switch the tool from "boring" to "cutting" and vice versa, the control apparatus comprises a guide means for the closure bodies as a valve means. Using these, the two diametrically opposed closure bodies can be optionally displaced onto a pair of openings in the flow body for the boring function or to a different pair of openings for the cutting function. When the pair of openings for the boring function is closed by the closure bodies, the opening pair for the flow paths of the water for cutting is free and vice versa.

For switching from the boring function to the cutting function, the operating pressure is lowered and the control apparatus is turned by 90° each time by a manually externally operable drive as the driving apparatus. In this case, the drive consists of a bevel gear meshing with a corresponding bevel gear at the top portion of the control apparatus and causing rotation of the control apparatus of the guiding means by 90° for switching the tool.

The use of a pair of disk-shaped closure bodies for closing off the openings of the flow channels having their nozzles deactivated for the current function of the tool, when switching the tool, is very advantageous for the residual or switching pressure, unlike large surface areas of valve plates of tools described further below. This is because the forces acting on the closing body via the switching pressure, which are caused when the closure bodies are displaced by means of the guiding means, are comparatively small.

However, the tool could be even further improved by simplifying the switching apparatus for switching the tool from the boring function to the cutting function and vice versa.

From SU 1 120 693, a tool for cutting up coke for use in decoking plants is disclosed, which is destined for boring a central hole in the coke material in the drum-shaped containers of the decoking plant and for cutting this material by means of a high-pressure water jet and which allows switching the tool from the cutting function to the boring function and vice versa.

The water is supplied to the tool from the drill stem to a supply chamber within the housing from the top in the operating position of the tool. Nozzles for boring are at the lower end of the housing of the tool and nozzles for cutting are arranged at an essentially central position of the housing. The nozzles for boring communicate with the supply chamber via flow channels, and the nozzles for cutting communicate with the supply chamber via an internal cavity in the housing. In the supply chamber, a valve plate is mounted at the bottom and has four openings, i.e. two openings for the flow channels and two openings for the cavity. A distributing disk having two diametrically opposed openings is rotatably supported on the stationary valve plate. When these openings are aligned with the openings of the flow channels in the valve plate, the water flows to the boring nozzles. However, when these openings are aligned with the openings of the internal cavity in the valve plate, the water flows to the cutting nozzles.

To switch the tool from the boring function to the cutting function and vice versa, a switching drive manually operable from the outside is provided in the top of the housing with a gearbox for rotating the distributing disk by about 90° each time. This is how the two openings of the distributing disk are optionally either brought in flow communication with the openings of the flow channels or with the openings of the cavity, while the two other openings of the valve plate are meanwhile closed off.

At the operating pressure of the water, the large distributing disk is pressed onto the valve plate with a correspondingly high pressure. For switching the tool, therefore, the operating pressure must be reduced almost to the ambient pressure with considerable trouble. Otherwise the friction between the distributing disk and the valve plate and the risk of damaging the surfaces with debris is too high.

The switching drive only manually operable from the outside is additionally bothersome, so that this prior art tool cannot be seen as an approach for simplifying the switching operation of the tool.

However, from SU 1059883, water-pressure-controlled switching from "boring" to "cutting" is known for the above described tool.

To realize this, a water-pressure-controlled switching apparatus is arranged in the stationary valve plate and in a central hub portion of the rotatable distributing disk. In a bore of the valve plate, a piston is arranged, on which a coil spring acts from one side and the pressure of the water acts from the other side. A toothed section of the piston meshes with a pinion of a rotatable axle, by means of which the distributing disk is rotated by 90° in the switching operation.

For switching e.g. from "boring" to "cutting", the water pressure is lowered in the tool so that the spring displaces the piston, and the latter rotates the pinion by means of the toothed section, and the pinion, in turn, rotates the rotatable distributing disk via the axle by 90°.

When the water pressure is increased again for cutting, the piston is displaced in the reverse direction and the spring is compressed. To prevent the reverse movement of the piston from causing another switching operation, the pinion has a ratchet means for a free-wheeling function of the piston in the reverse movement.

The arrangement of the switching apparatus within the stationary valve plate and in the distributing disk makes maintenance work bothersome and often causes failure because of debris in the switching apparatus mounted in a hidden position.

From U.S. Pat. No. 5,816,505 (FLOWSERVE) a tool of the same type and with the same structure as indicated above with respect to SU 1120693 is known, which allows the boring or cutting functions to be selectively and manually switched by means of a distributing disk rotatably supported on a flow-through body. Two openings of the flow-through body together, again, form the access to flow channels in the flow-through body. Depending on the angular position of the distributing disk, they guide the water to the boring and cutting nozzles via separate annular cavities.

To switch the tool from the boring function to the cutting function, a control rod extends from the rotatable distributing disk to the bottom and through the flow-through body allowing for the manual switching of the tool at the bottom of the housing. By manually turning the control rod the distributing disk can be rotated by 90° so that with the switching operation the two hitherto closed openings in the flow-through body, e.g. those of the flow channels leading to the boring nozzles for the boring function, are opened and the two hitherto free openings, i.e. those of the flow channels leading to the cutting nozzles, are closed. Manual switching of the tool at its underside, where the tool must be completely extracted from the coke container, is cumbersome and causes corresponding interruptions of operation and considerable work. Moreover, it has the drawback that large surfaces are pressed together at operating pressure and have to be almost completely depressurized for switching.

One version of this tool which allows for the automatic, i.e. water-pressure-controlled, switching of the boring and cutting functions by lowering the operating pressure of the water can be derived from DE 103 92 866 and the identical U.S. Pat. No. 6,644,567 (both FLOWSERVE). While the above indicated flow separation by means of a rotatable distributing disk on the surface of a stationary flow-through body, with flow channels and annular cavities to be opened according to the selected boring or cutting operating mode and leading to the corresponding nozzles, is maintained, the control rod passing to the bottom through the flow-through body is not manually switchable, but switchable by means of a water-pressure-controlled switching apparatus.

The switching apparatus is arranged, however, in an additional switch housing, which is set on the bottom—with respect to the operating position of the tool—of the housing of the tool, and wherein the above mentioned control rod extends with an extension as a bottom control rod.

A piston displaceable by a hydraulic cylinder in a coaxial position to the bottom control rod and as a function of water pressure holds an actuation pin carrier in a bottom position at operating pressure in the switch housing against the pressure of biasing springs. The actuation pin carrier, via at least one actuation pin, engages at least one spiral groove of an actuation sleeve coaxially mounted on the bottom control rod via a control rod sleeve. The control rod sleeve has pawls on the inside spring-biased against teeth on the bottom control rod which catch behind the teeth in one direction of rotation of the control rod sleeve and rotate the bottom control rod, and which, in the other direction of rotation of the control rod sleeve, only slide on the teeth of the bottom control rod (freewheel) in a spring-biased condition.

When the operating pressure is substantially reduced for switching the tool and the pressure acting on the annular piston is correspondingly reduced, the springs compressed in the lower position make the actuation pin body rise. This causes the actuation sleeve to be rotated by 90° via the actuation pin. The control rod sleeve is rotated with it and, in turn, rotates the bottom control rod via the pawl-tooth engagement. This rotary movement of the bottom control rod acts on the distributing disk above the flow body via the top control rod so that it is also rotated by 90° and the hitherto closed openings of the flow channels are exposed and the other hitherto free openings are now closed by the distributing disk. This is how the switching operation is completed. When the water pressure is raised to the operating pressure again, the actuation pin body is pressed down against the pressure of the springs, however, without renewed switching. This is because now there is no tooth-pawl engagement so that a freewheeling effect is caused and the backward rotation of the control rod sleeve is not transferred to the bottom control rod.

This water-pressure-controlled switching device causes the length and weight of the tool to be considerably increased so that the cost of manufacture and handling of the tool are also increased. A further drawback is still the inevitable drastic reduction of the operating pressure to a minimal switching pressure prior to switching because of the otherwise excessive friction between the surfaces of the distributing disk and the flow body.

A compact structure of a fluid-pressure-controlled tool is shown in DE 39 41 953, wherein an axial movement of a piston serving to supply the water to the boring and cutting nozzles between a top position (cutting) and a bottom position (boring) is caused by an annular cylinder as a function of hydraulic pressure. This pressure is generated, however, by an external hydraulic pressure source and introduced into the tool by means of separate lines and correspondingly controlled for switching. The use of an additional hydraulic pressure source with separate lines extending adjacent or on the drill stem to the tool and in the tool causes high structural cost and has the further drawback that the separate lines are easily damaged in the rough practical conditions of the decoking plant.

In practice it is required that the drum filled with coke is emptied by the use of a decoking tool in as short a time as possible. This requirement can be met by a tool which uses the water jets supplied by a high-pressure pump with high efficiency for boring and cutting the coke material and allowing quick and simple switching of the tool from the boring function to the cutting function. The manual workload should be as small as possible.

SUMMARY OF THE INVENTION

The present invention refers to a tool for cutting up coke, comprising

- a housing mounted on a drill stem in the operating condition, and wherein
- at least one cutting nozzle for cutting and a boring nozzle for boring coke by means of a water jet, and a switching apparatus for controlling the feeding of pressurized water flowing through the drill stem and the housing are arranged, wherein the switching apparatus for switching the tool comprises a linearly moveable switching element, a driving apparatus and a control apparatus, which is rotatable about the longitudinal axis of the housing as a function of a change of the water pressure by means of the driving apparatus to switch a valve means to distribute the water and to pass it on, wherein depending on each angular position of the control apparatus the flow path of the water to the boring nozzle or the flow path to the cutting nozzle is free or obstructed.

Based on a tool of the initially mentioned type, therefore according to the present invention a tool is suggested for the decoking technology, wherein the switching apparatus is arranged in the housing of the tool above the area in which a separation of the supply path of the water is provided in the housing into flow channels for the water to be fed to the boring nozzle and the cutting nozzle, and it comprises a switching element arranged in the water flow path and moveable transverse to the longitudinal axis of the housing, which is coupled with means for converting the linear movement of the switching element into a rotary movement of the control apparatus.

As a consequence, according to the present invention, the rotation of the control apparatus for switching the tool from the boring function to the cutting function and vice-versa, by the angle required for switching, is carried out by a switching apparatus arranged above the area of the flow separation or the valve means. This causes the components of the switching apparatus to be freely exposed in the water supply and continuously cleaned and lubricated. The space requirements are small. The switching element is coupled with means for converting its linear movement into a rotary movement of the control apparatus.

For switching, a substantial reduction of the operating pressure of the water from about 300 bars to e.g. about 15 bars is preferred, which is referred to as the switching pressure in the following.

The movement directed in a transverse direction to the longitudinal axis of the housing of the switching element, allows a space-saving arrangement of the switching apparatus so that no extension of the housing is necessary. The old tool height may be kept, as can the old structure and the valve apparatus of the tool provided with closure bodies, which applies, in particular, to the above indicated tool according to WO 2005/105953 A1. The application of the present invention is not limited, however, to that tool. It may be applied in any case, where for switching the tool, a change of the angular position of the control apparatus for the flow paths of the water to the boring nozzle or to the cutting nozzle is caused by rotating the control apparatus.

Preferably, the switching element engages a control member for rotating the control apparatus to convert the linear movement of the switching element into a rotary movement of the control apparatus.

Preferably, the control member is formed as a cam profile (control profile) to be engaged with the switching element by the driving apparatus of the switching apparatus for rotating the control apparatus. For this purpose the cam profile may be formed in such a manner that the conversion of the linear movement of the switching element into a rotary movement of the control apparatus is such that it is adapted to the operating manner of the control apparatus during switching.

According to an embodiment of the present invention it is provided that the switching element can be brought from an inactive position to an active position in the area of the control apparatus by the driving apparatus at a switching pressure of the water, i.e. at a water pressure substantially reduced with respect to the operating pressure, in such a way that the switching element engages the cam profile of the control apparatus for rotating the control apparatus and that the switching element can be brought back into an inactive position in the switching apparatus by raising the pressure of the water above the switching pressure. Basically, various means may be used for coupling the switching apparatus and the control member of the control apparatus for converting the linear movement of the switching element to a rotary movement of the control apparatus, in the most basic case, a toothed rack attached to the front end of the switching element meshing with a gear as the control member of the control apparatus. Irrespective of whether a continuous engagement exists between the preferred cam profile of the control apparatus and the switching element or whether the engagement is only for the duration of the switching movement, the movement of the switching element is between an active and an inactive position in the switching apparatus. Since the movement of the valve means for redirecting the passage of the water is brought about by the control apparatus, the passage of the switching element from the inactive position to the active position is at a switching pressure of the water which is as low as possible, to keep the wear, and in particular the friction, on the components directly involved with the switching, as low as possible.

Preferably the switching element has a piston linearly moveably supported within the driving apparatus and having a switching member at its free end portion which engages the cam profile of the control apparatus for rotating the control apparatus. The piston in the driving apparatus reacts to the switching pressure of the water with a linear movement, and the switching member at its free end portion causes the desired rotation of the control apparatus, when the switching member engages the cam profile of the control apparatus during the linear movement of the piston.

According to an embodiment of the invention it is provided that the driving apparatus comprises a cylinder and a piston linearly moveable within the cylinder and connected to the switching element, the piston being under the effect of a spring for pressing the piston from the inactive position to the active position when the water is at switching pressure. The linear movement of the switching element is caused by the movement of the piston within the cylinder. In the inactive position, the piston is retracted, and the spring is compressed. When the pressure in the water is lowered to the switching pressure to switch the tool, the spring is relaxed and drives the piston from the inactive position to the active position so that the switching member of the piston engages the cam profile of the control apparatus and causes switching.

Preferably, the spring and the piston hold the switching member in engagement with the cam profile during switching of the control apparatus, and are pressed back into the inactive position by applying a pressure of the water above the switching pressure. The spring as a part of the driving apparatus, is to be adjusted to the force acting on the piston at switching pressure so that the switching member maintains its engagement with the cam profile during the duration of the switching movement of the control apparatus and the piston returns to the inactive position at the end of the switching movement when the switching pressure is exceeded again.

According to an embodiment of the invention, it is provided that the switching angle of the control apparatus is essentially 90° and the cam profile comprises two cam arcs separated by a separating wall and arranged in mirror image, wherein one is associated with switching the water flow from cutting to boring and the other is associated with switching the water flow from boring to cutting. Basically it is possible to provide the cam profile with only one cam arc on which the switching member, during switching, passes through the cam arc in one direction and carries out the next switching process on its way back, wherein a reciprocating motion from the active to the inactive position of the switching element is carried out at the end of the cam arc. Switching the control apparatus while the switching member passes through the cam arc with a so-called freewheeling action on the reverse path of the switching member, is also possible. According to the invention, separate cam arcs are associated, however, with the functions of cutting and boring, which are separated by a separating wall.

According to an embodiment of the invention, it is provided that the cam profile is formed on the sides of arms fixed to the control apparatus which are juxtaposed to the switching member in the inactive position of the switching apparatus in such a way that the switching member is engageable with the cam profile. The arms carrying the cam profile are preferably thin profiles, so that only a very low resistance is caused for the water flowing through the area of the control apparatus.

Preferably, the switching member is pivotably supported at the free end portion of the piston and is held in a central starting position, laterally pivotable in two directions in a spring-biased manner. This support of the switching member gives more leeway with the design of the cam profile which is displaced by the switching member during its movement along the cam profile to generate a rotary movement of the control apparatus. However, the switching member will always return to the central starting position due to its central spring bias after rotary or pivoting movements.

It is further preferred that the movement of the piston from the inactive position to the active position can be coupled with pivoting movements of the switching member after the switching member contacts the cam profile for a continuous engagement of the switching member during its relative movement on the cam profile. In this way, possible pivoting movements of the switching member are overlapped with the linear movement of the piston.

An extended separating wall between the two cam arcs of the cam profile are for bringing the switching member to a starting position for the next switching operation after switching the tool.

Basically an arrangement of the switching apparatus according to the present invention within the housing of the tool is possible below the area of the supply paths of the water to the boring and cutting nozzles, e.g. by using a coupling member such as a control rod, passing upwards into the area of the flow control by means of valve components. This embodiment forms a separate invention. It is preferred, however, that the switching apparatus is arranged within the housing of the tool above the area in which a separation of the supply paths of the water is provided in the housing into flow channels for the water to be fed to the boring nozzle and the cutting nozzle. The advantages of such an arrangement have already been mentioned above.

The incorporation of a well-proven arrangement is also preferred, according to which the control apparatus is rotatably supported on a flow body within the housing of the tool, in which the flow channels of the water extend for the boring and cutting nozzles.

A simple and space saving connection between the rotatable control apparatus and the flow body is primarily achieved by fixing a bearing pin on the top side of the flow body, on which the control apparatus is rotatably supported with a hub member.

An embodiment of the present invention is characterized by means for alternatively closing and exposing openings of the flow channels depending on each desired function of boring or cutting of the tool.

These means preferably comprise closure bodies for closing off the openings of the flow channels, and the control apparatus preferably comprises a guiding apparatus for moving the closure bodies for switching the water flow. This embodiment of the valve apparatus allows a reduction of the effect of the water pressure on preferably circular closure bodies having a diameter only slightly exceeding the diameter of the openings of the flow channels to be closed—unlike valve apparatus involving disks or plates having a diameter which corresponds to the inner diameter of the housing. However, the invention is still applicable to such valve apparatus if the intention is to create a rotary movement for a disk-shaped valve plate.

Suitably the arms comprising the cam profile are attached above the guiding apparatus of the control apparatus on the latter. To achieve this, the arms bearing the cam profile are suitably attached, by means of supports, to the guiding apparatus for moving the closure bodies. This is how a compact unit of the components of the control apparatus is created, which are involved with converting the linear movement of the piston to a rotary movement of the control apparatus and with displacing the closure bodies during switching.

A further embodiment of the invention is particularly important to create flow paths for the water which are as free as possible, according to which the guiding apparatus comprises, along its circumference, segment-shaped chambers, open at the bottom, for the overlap of the closure bodies, as well as segment-shaped openings, and the structure and position of the arms is chosen such that the segment-shaped openings remain free for the water flow. In this way the water flow, during the operation of the tool, can freely reach the openings of the flow channels in the area of the segment-shaped openings and can pass into these.

BRIEF DESCRIPTION OF THE DRAWINGS

An exemplary embodiment of the present invention will be described with reference to the accompanying drawings below in more detail, in which.

DETAILED DESCRIPTION

Figure 1:
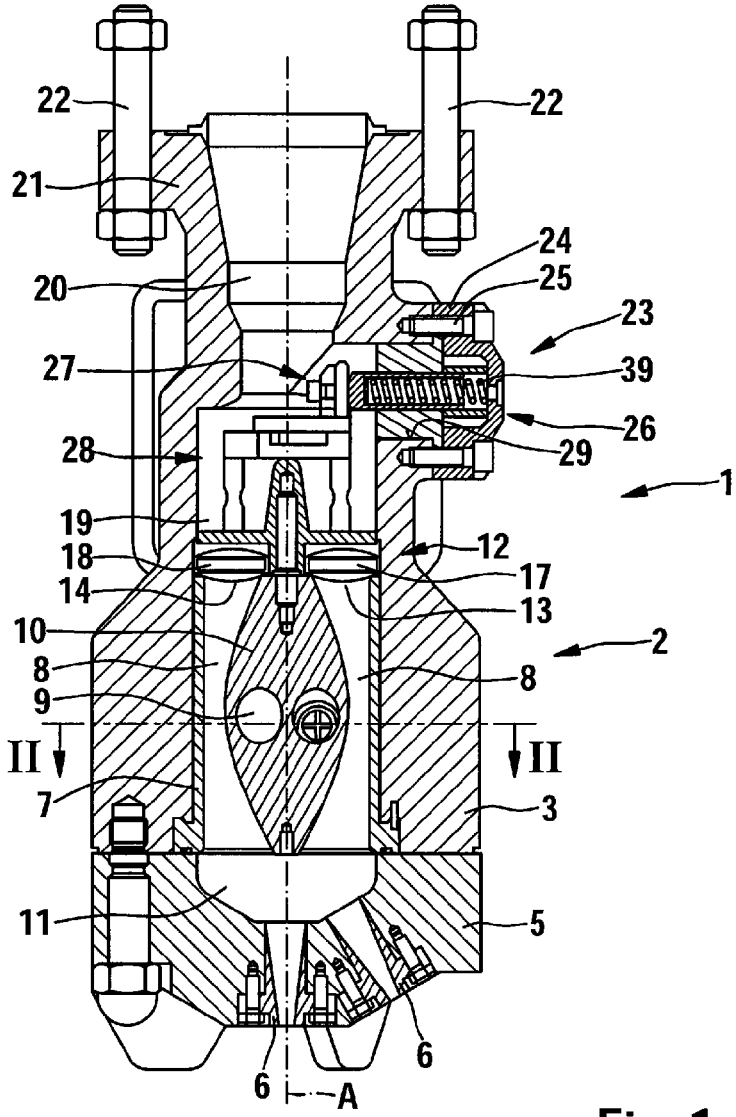
FIG. 1 is a longitudinal sectional view of a tool for cutting up coke.
Figure 2:
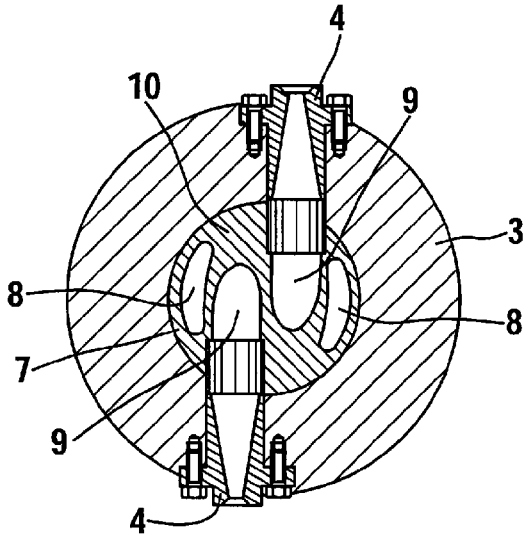
FIG. 2 is a cross-sectional view along line II-II in FIG. 1 of the tool according to FIG. 1.

A tool 1 shown in FIGS. 1 and 2 for cutting up coke in a drum (not shown) comprises a housing 2 formed as a cast part, having fixed on its top portion 3, comprising cutting nozzles 4 (cf. FIG. 2), a bottom portion 5, comprising boring nozzles 6, as shown.

In housing 2 a hollow cylindrical inset 7 having an essentially cylindrical flow body 10 is arranged, through which flow channels 8, 9 extend (cf. FIG. 2), having their top openings 13, 14 and 15, 16 (cf. FIG. 3) closable in pairs by two disk-shaped closure bodies 17, 18 of a valve means 12. The valve means 12 closes a flow channel 19 into which a supply channel 20 opens out, which is surrounded by a flange 21 at its top end.

In use, tool 1 is attached via flange 21 at the bottom end of a drill stem (not shown) through which water is guided in the operation of tool 1 under a high operating pressure of e.g. 300 bar and through tool 1. Within the latter, depending on each switching position of a control apparatus 28 connecting a switching apparatus 23 with the valve means 12, the water is passed either through the flow channels 8 and through an expansion 11 to boring nozzles 6, or via the flow channels 9 to cutting nozzles 4, and discharged for boring or cutting the coke material.

Switching apparatus 23 extends from a housing cover 24 releasably mounted on top portion 3 of housing 2 by means of bolts and sealed with suitable means transverse to the longitudinal axis A of tool 1 in its radial direction up to the area of control apparatus 28.

Figure 3:
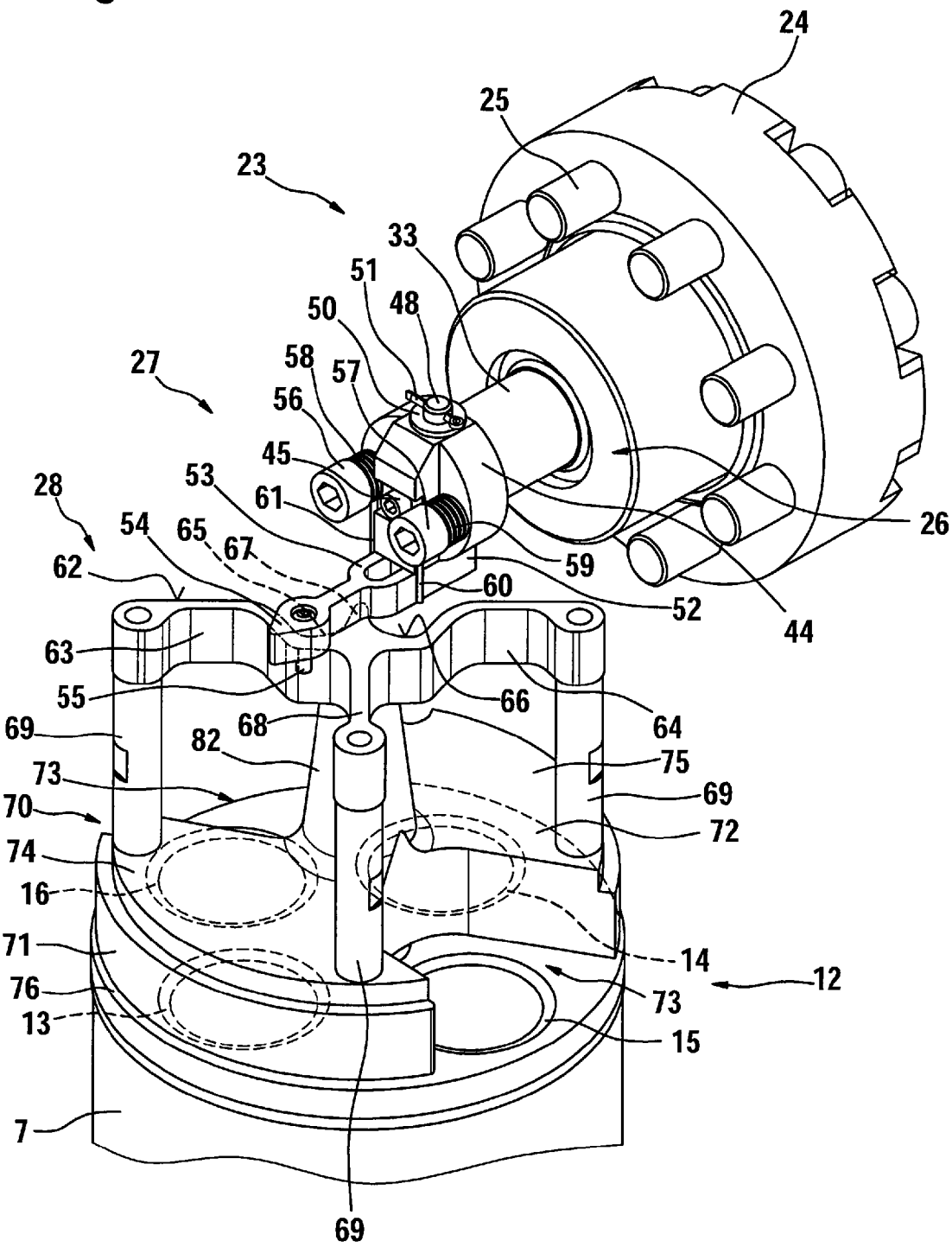
FIG. 3 is a perspective view of a switching apparatus arranged within the tool according to FIGS. 1 and 2 having a driving apparatus and a switching element cooperating with a control apparatus for actuating a valve means.
Figure 4:
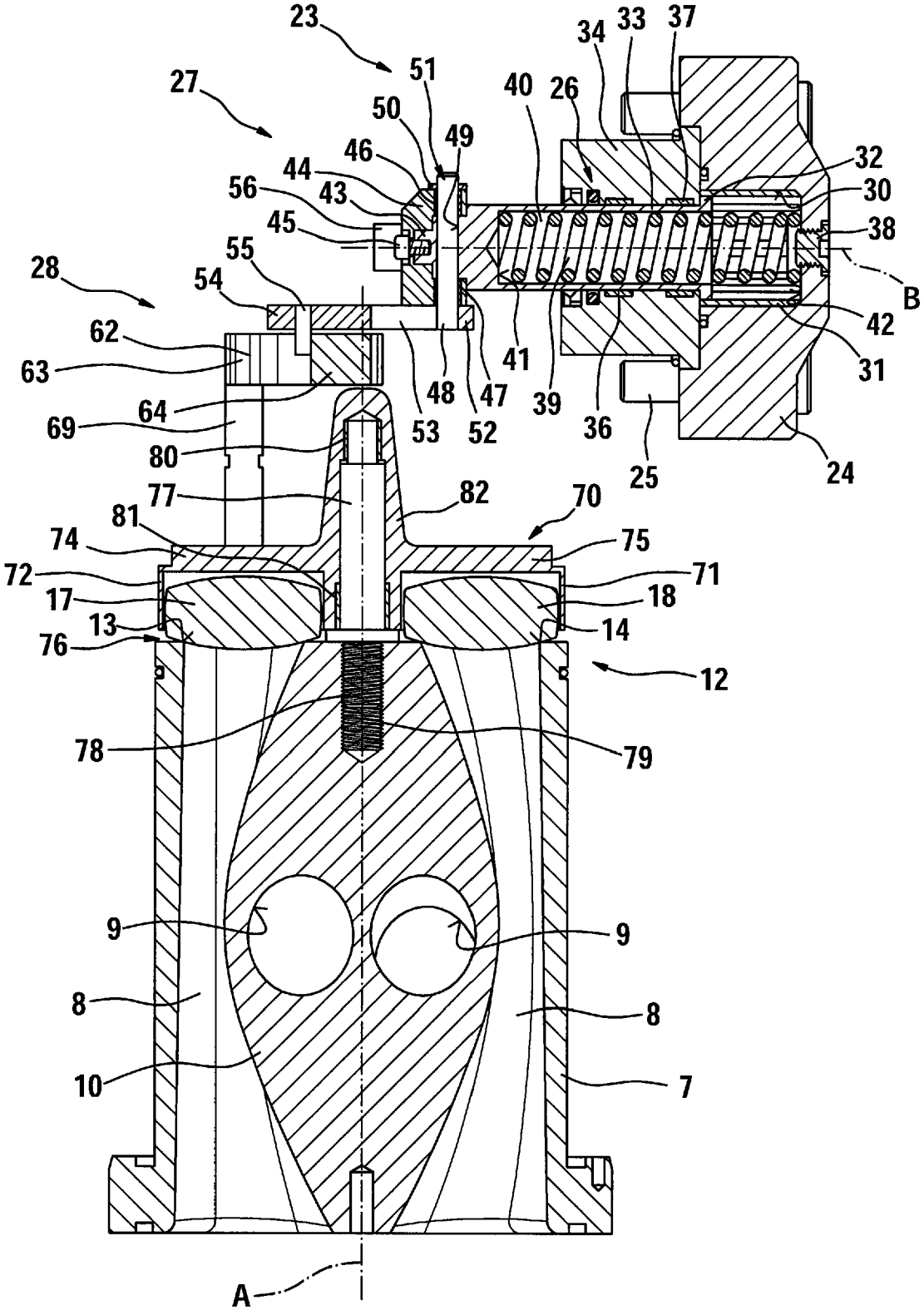
FIG. 4 is a sectional view of the components cooperating for controlling closing and opening of flow channels within the tool of FIGS. 1 and 2, comprising the switching apparatus, the driving apparatus, the switching element, the control apparatus and the valve means.

It can be seen from FIGS. 3 and 4, in particular, that a bore 30 of housing cover 24 has a splined hub 31 set in to receive a splined ring 32 at the end of a piston 33 to enable an anti-twist movement of piston 33 along a transverse axis B in a cylinder 34. Cylinder 34, as shown, is set in housing cover 24 and held and sealed by a shoulder 35, when housing cover 24 is mounted in top portion 3 of housing 2. A centrally arranged opening in housing cover 24 is closed and sealed by a plug 38. The engagement of the splined elements of splined ring 32 with the corresponding profile of splined hub 31 prevents, as already indicated, twisting of piston 33 during axial movement of piston 33 within cylinder 34 and within splined hub 31 itself. Guiding grooves 36, 37 set in the bore of cylinder 34 enable easy sliding of piston 33 within cylinder 34.

Piston 33 is formed as a hollow piston open on the end in the area of splined ring 32, and in its longitudinal bore 40, a coil spring 39 is arranged as a pressure spring and energy store which, in combination with piston 33 and cylinder 34, forms an essential part of driving apparatus 26. Coil spring 39 is supported at its one end on bottom 41 of longitudinal bore 40 and with its other end on a bottom 42 of bore 30 in housing cover 24.

Piston 33, at its free end, has a projection 43 with its diameter reduced in steps, on which a head plate 44 is set and attached by means of a cylinder head screw 45 on projection 43.

Head plate 44 covers projection 43 of piston 33 and has bores with bearing bushings 46, 47 in this area for rotatably bearing a pivot pin 48. The latter also extends through a bore 49 in projection 43 of piston 33 and is axially supported and held at the top with a disk 50 and a split-pin 51 fixedly set in pivot pin 48.

The lower end of pivot pin 48 is attached at connecting end 52 of a switching member 53 in the manner shown, which extends to the front from the area below head plate 44 and parallel to transverse axis B of piston 33. Switching member 53 is formed with a tulip-formed cross section at its free end as a head 54. A switching pin 55 projecting to the bottom is fixed within head 54.

Two head bolts 56, 57 are screwed into head plate 44 in the position shown in FIG. 3 at the front side of head plate 44, each having a helical torsion spring 58, 59 set between the head and the front side of head plate 44, wherein their spring ends 60, 61 each contact one side of switching member 53 under spring pressure, as shown in FIG. 3. This achieves that switching member 53 is held in a central position parallel to axis B but laterally pivotable under spring bias about the axis of pivot pin 48 in two directions.

Switching pin 55 of switching member 53 is for engagement with a cam profile (control profile) 62 on two arms 63, 64 of control apparatus 28. Cam profile 62 comprises a cam arc 65 on arm 63 for switching tool 1 to the "cutting" function, and, separated from the latter by a projecting separating wall 67 (FIG. 3), a second cam arc 66 on arm 64 for switching tool 1 to the "boring" function, as will be described in more detail below.

Due to this configuration of driving apparatus 26 in switching apparatus 23, it is achieved that piston 33 with switching member 53 at the front end is pressed from an active position shown in FIGS. 1, 3 and 4, in which—depending on the dimensions of driving apparatus 26—a switching pressure is present reduced to about 15 bars from the operating pressure of the water, back to an inactive position within cylinder 34. This happens when—usually after tool 1 has been switched from "boring" to "cutting" or vice versa—the water pressure is increased above the switching pressure to continue with the operation of tool 1.

The return force acting on piston 33 results from the product of the cross sectional area of piston 33 and the raised water pressure. In all other moveable elements of switching apparatus 23 there is no surplus pressure from which a pressure force results. As piston 33 is pressed back to the stop of splined ring 32 on bottom 42 of bore 30, coil spring 39 is compressed as an energy store and switching member 53 almost touches the front surface of cylinder 26. This is how switching apparatus 23 with its components, such as, in particular, piston 33, assumes its inactive position.

When the operating pressure of the water is reduced at the end of an operating duration for switching tool 1 from "boring" to "cutting" or vice versa and reaches or falls below the switching pressure, the pressure force acting on piston 33 falls below the return force of coil spring 39 so that coil spring 39 presses piston 33 from the inactive position to the active position. This means that piston 33 together with the switching parts it carries on its free end, moves to the left (as seen in FIGS. 3 and 4) until switching pin 55 engages one of cam arcs 65, 66 of cam profile 62 and a continuation of the movement of switching pin 55 causes the switching of the "boring" or "cutting" operating mode of tool 1 as can be seen from the following continuation of the description of control apparatus 28 and valve means 12.

From the connection area of arms 63, 64, in the plane of these arms, a carrying arm 68 extends in the manner shown in FIG. 3, which contributes to reinforcing and supporting the construction. Arms 63, 64 and carrying arm 68 are attached on supports 69 in the manner shown, which in turn are attached on a guiding apparatus 70. The latter comprises, as shown in FIGS. 1, 3 and 4, segment-shaped chambers 71, 72 open at the bottom, which overlap with closure bodies 17, 18, and between which segment-shaped openings 73 are formed. The segment-shaped bottoms 74, 75 of chambers 71, 72 of guiding apparatus 70 overlap in every position with disk-shaped closure bodies 17, 18 dome-shaped at their lower and upper sides, such as in the "cutting" operating position shown in FIG. 4, where closure bodies 17, 18 close off flow channels 8 leading to boring nozzles 6. Due to the support of the carrier of chambers 71, 72, there is a gap 76 between segment-shaped chambers 71, 72 and the upper surface of flow body 10.

On the top surface of flow body 10, in a coaxial position to the latter, a bearing pin 77 with a threaded section 78 at its lower end is fixedly screwed into a corresponding threaded bore 79 of flow body 10. A hub portion 82 supporting guiding apparatus 70 on bearing pin 77 with the interposition of a radial bearing sleeve 80 and an axial/radial bearing sleeve 81 is rotatably supported in the manner shown in the drawing. In this way, each displacement of cam profile 62 or corresponding cam arc 66 or 67 caused by switching pin 55 is easily converted into a rotary movement of control apparatus 28 with guiding apparatus 70 for displacing closure bodies 17, 18.

Figure 5A:
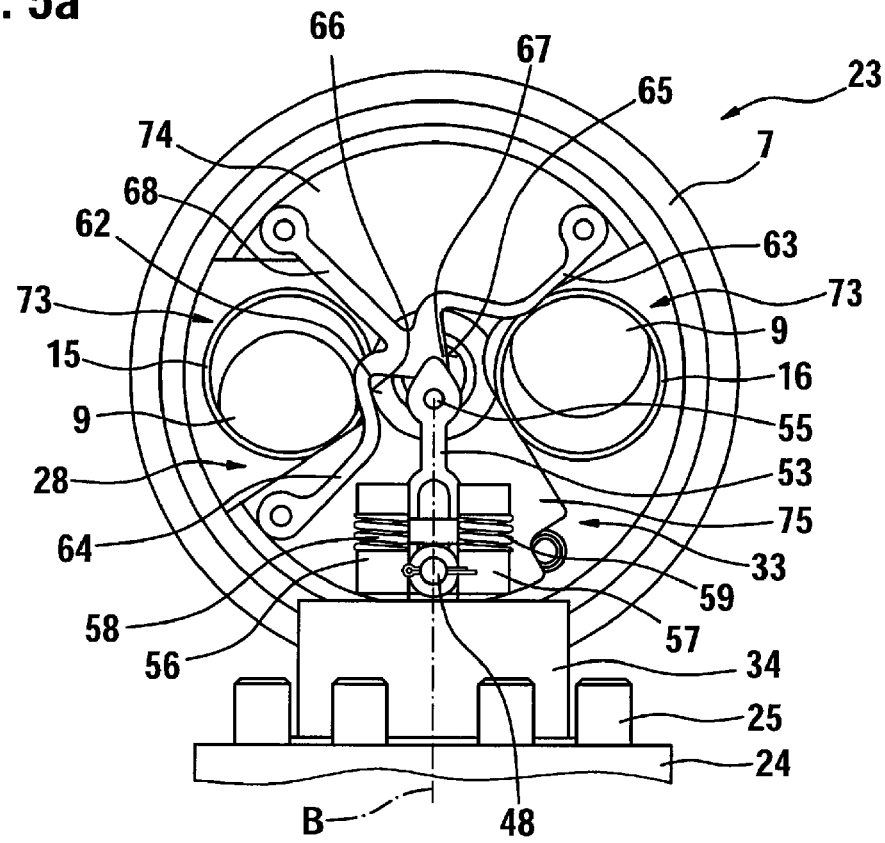
FIGS. 5*a*-5*m* show schematic views of the operation of the switching apparatus with the driving apparatus and, in particular, the control apparatus in a plan view.

With reference to FIGS. 5*a*-5*m*, a simplified model of parts of switching apparatus 23 and control apparatus 28 in a plan view will be taken to explain the sequence of movements when tool 1 is switched from "cutting" to "boring" and vice versa, wherein the same reference numerals indicate the same parts as in the previously described figures and wherein the reference numerals indicated in FIG. 5*a* also apply to the corresponding parts of the views of 5*b*-5*m*, as far as they are not also inserted in these figures.

In FIG. 5*a*, switching apparatus 23 is in an inactive position at operating pressure. This means that piston 33 with switching member 53 is retracted. Switching pin 55 engages none of the sections of cam profile 62 of arms 63, 64. Switching member 53 itself is held in a central position, i.e. in a position parallel to axis B of cylinder 34, by helical torsion springs 58, 59. The water flowing out of supply channel 20 (cf. FIG. 1) through passage channel 19 may freely and smoothly flow through large segment-shaped openings 73 between bottoms 74, 75, which close off chambers 71, 72 (FIG. 4) at the top, into openings 15, 16 of flow channels 9, and from there to cutting nozzles 4 (not shown).

Figure 5B:
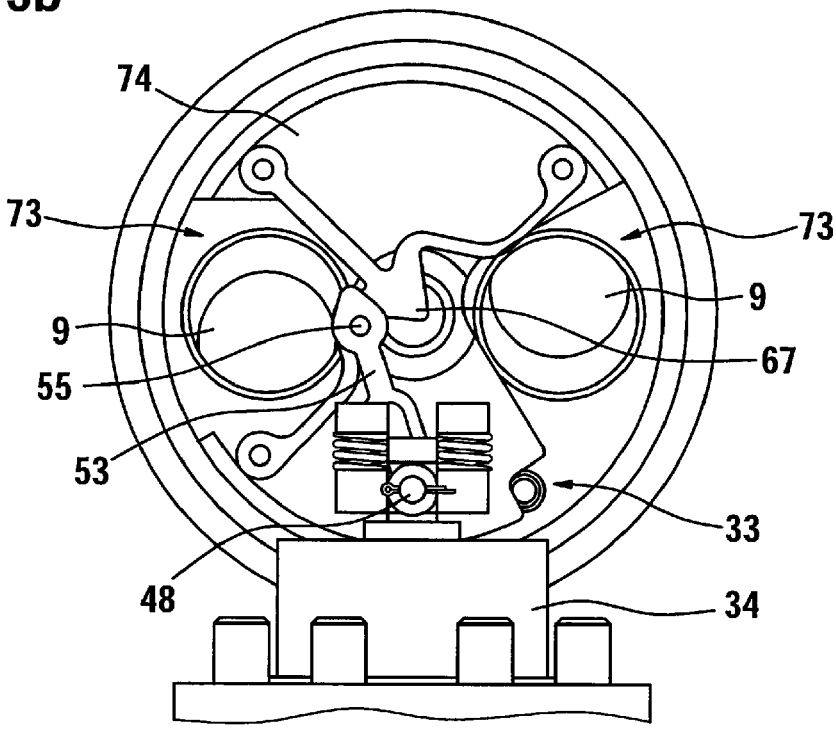

When the operating pressure of the water assumed for the condition of tool 1 according to FIG. 5*a* is reduced to the switching pressure for switching tool 1, or falls below the switching pressure, piston 33 is moved out of cylinder 34 in the manner shown in FIG. 5*b* under the effect of coil spring 39 not shown in the present model. This results in switching pin 55 first engaging separating wall 67 and then cam arc 66 (hidden), which acts to switch to "boring", wherein the advancing movement of switching member 53 overlaps with a rotary movement of the same about pivot pin 48.

Figure 5C:
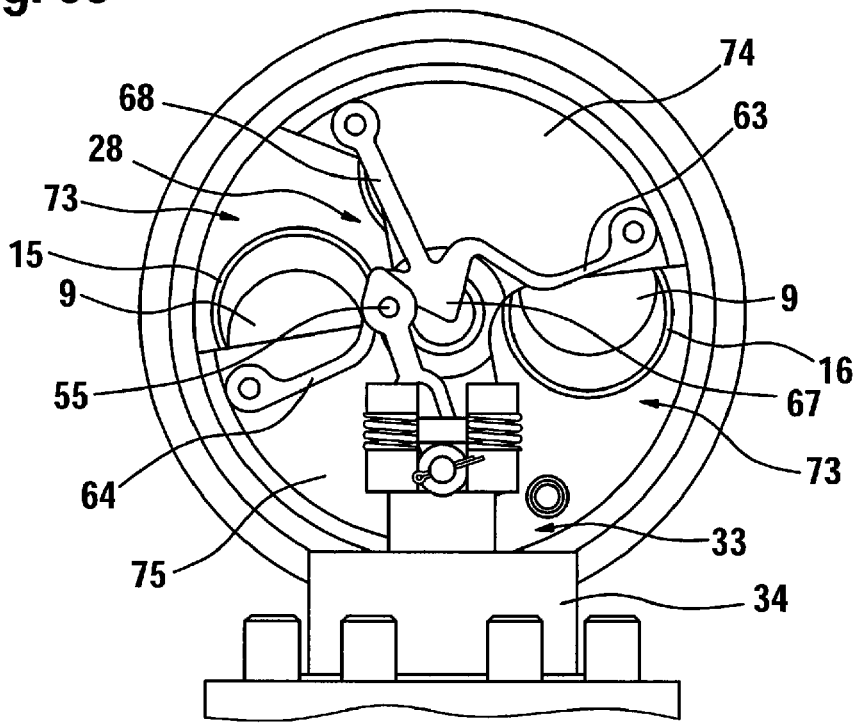

This movement of switching member 53 with the sliding movement of its switching pin 55 along cam arc 66 (hidden) of cam profile 62 is also continued in the intermediate position shown in FIG. 5*c*.

In this intermediate position of FIG. 5*c*, the switching operation of tool 1 from "cutting" to "boring" has already begun, however, by switching pin 55 rotating three arms 63, 64, 68 and therefore control apparatus 28 clockwise, by sliding further along cam arc 66 (hidden) while exerting the compressive force caused by coil spring 39 (not shown). Herein, the segment-shaped bottoms 74, 75 and the interposed segment-shaped openings 73 have been rotated clockwise by an angle so that openings 15, 16 of flow channels 9 are already partially covered. Piston 33 has been further advanced with respect to the intermediate position of FIG. 5*b*.

Figure 5D:
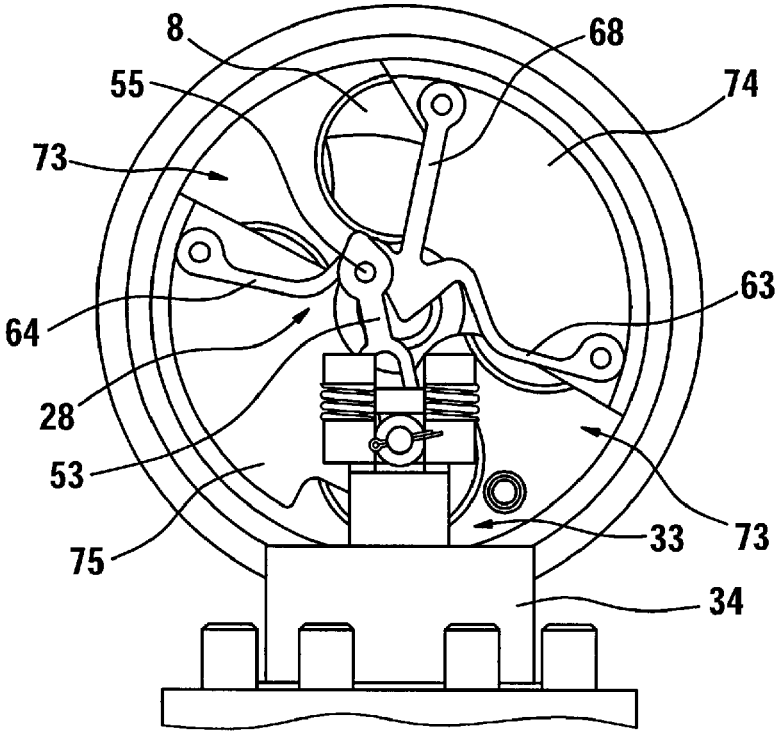

In FIG. 5*d* the rotary movement of control apparatus 28 is further continued.

Figure 5E:
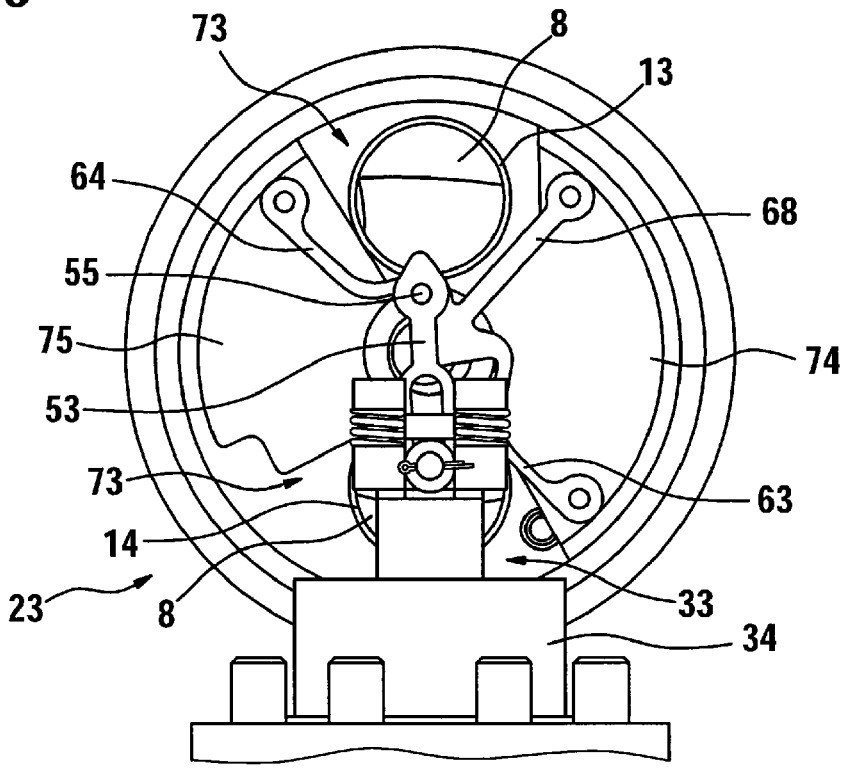

In FIG. 5*e*, the switching operation is completed. Piston 33 is fully extended. Segment-shaped bottoms 74, 75 meanwhile completely cover openings 15, 16 of flow channels 9. This means that closure bodies 17, 18 (not shown) now close openings 15, 16 and that segment-shaped openings 73 have exposed openings 13, 14 of flow channels 8 so that the path of the pressurized water to boring nozzles 6 is free.

Figure 5F:
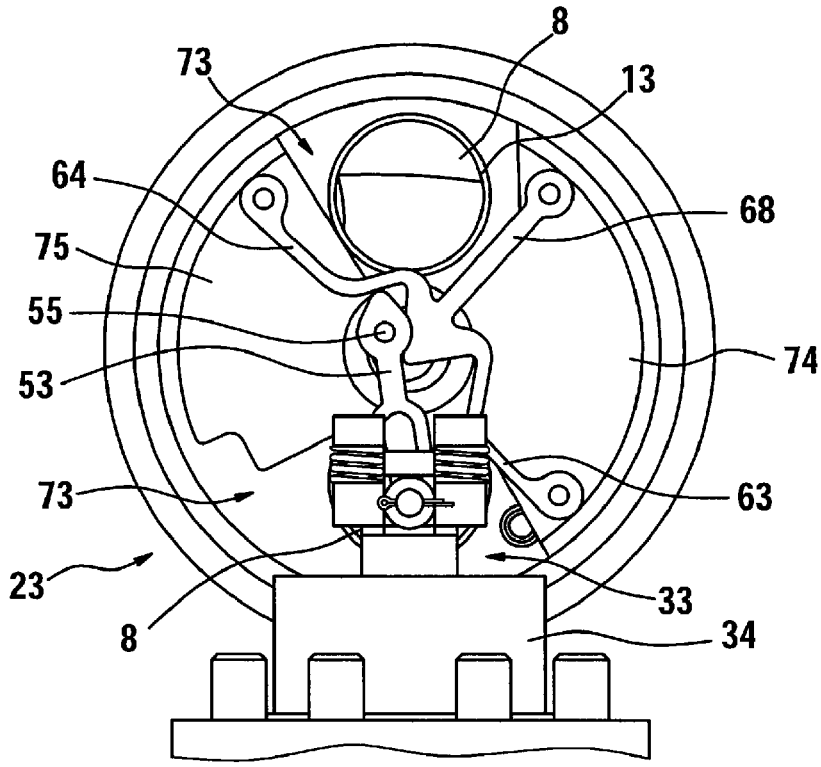
Figure 5G:
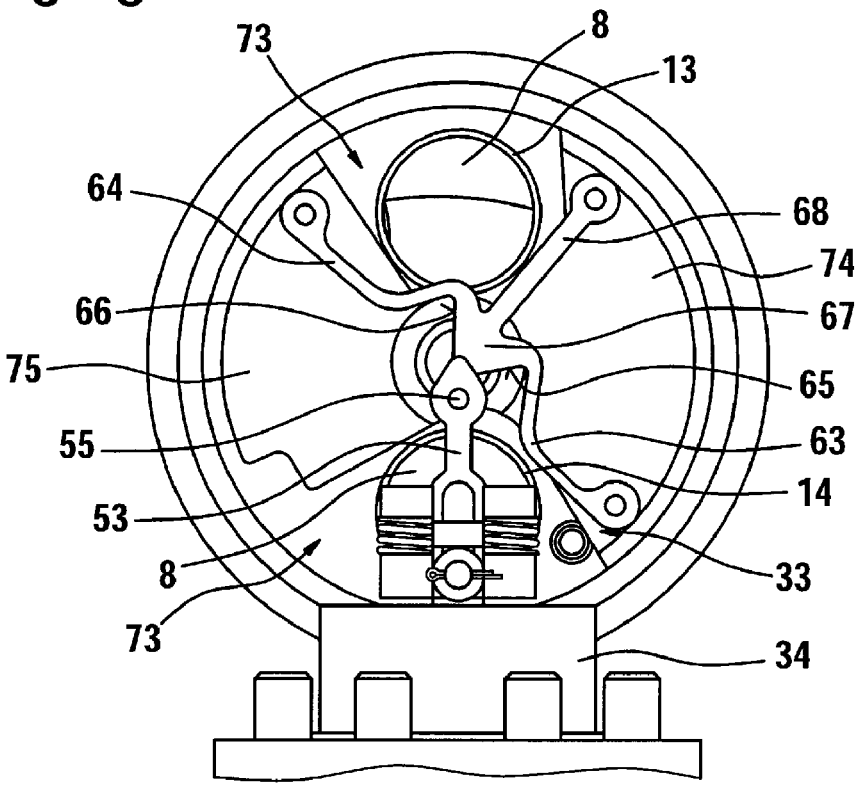
Figure 5H:
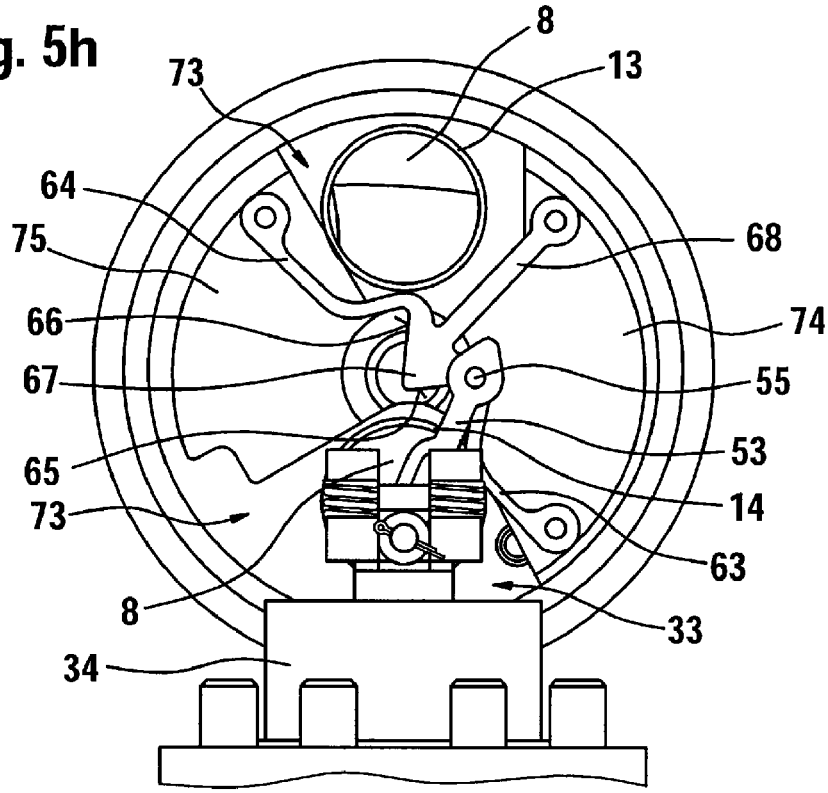
Figure 5I:
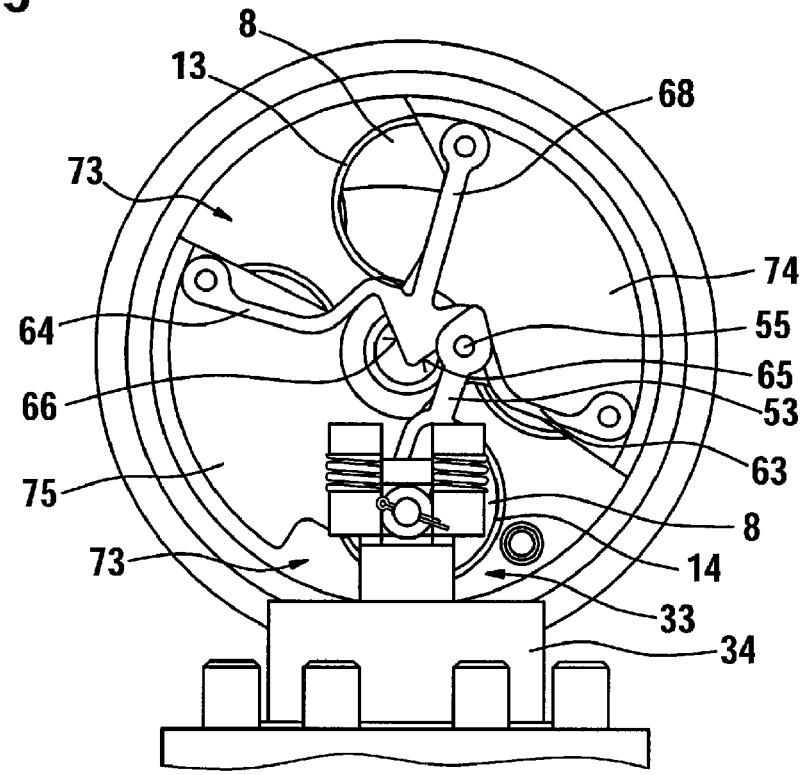
Figure 5J:
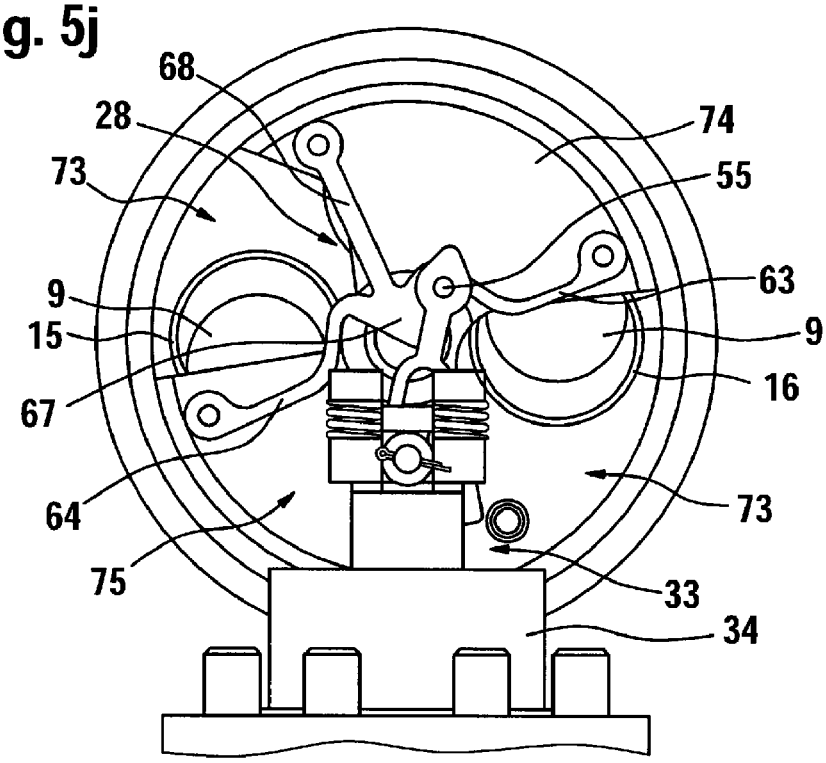
Figure 5K:
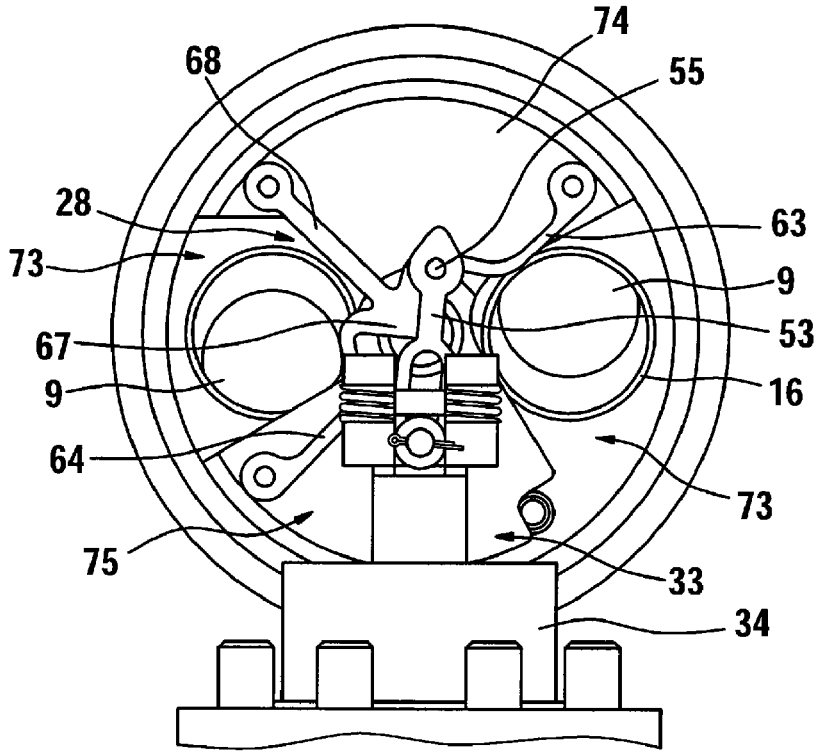
Figure 5L:
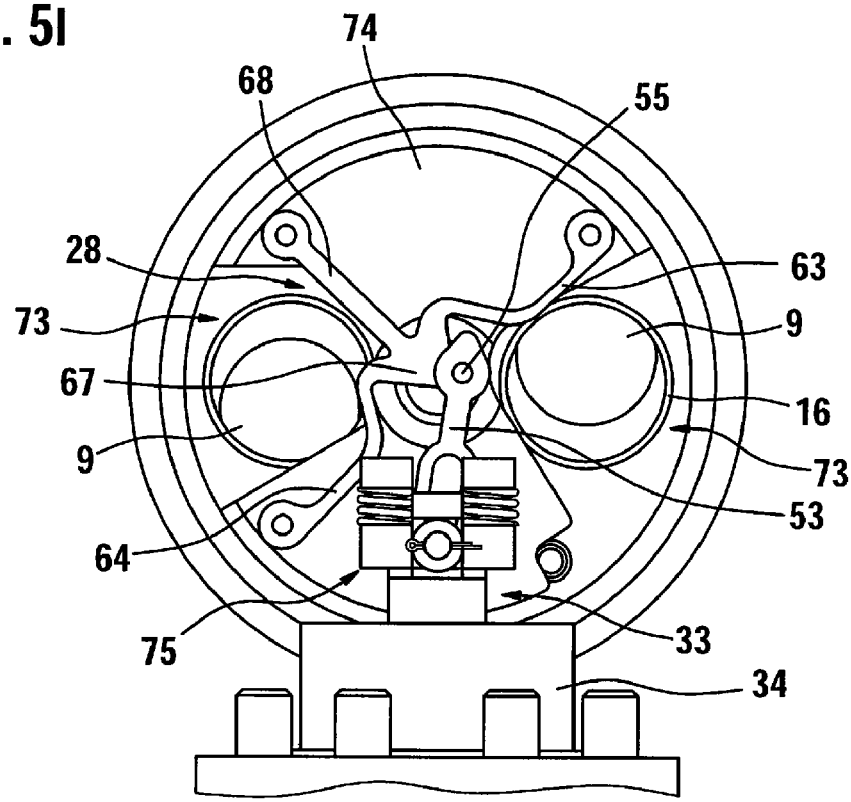
Figure 5M:
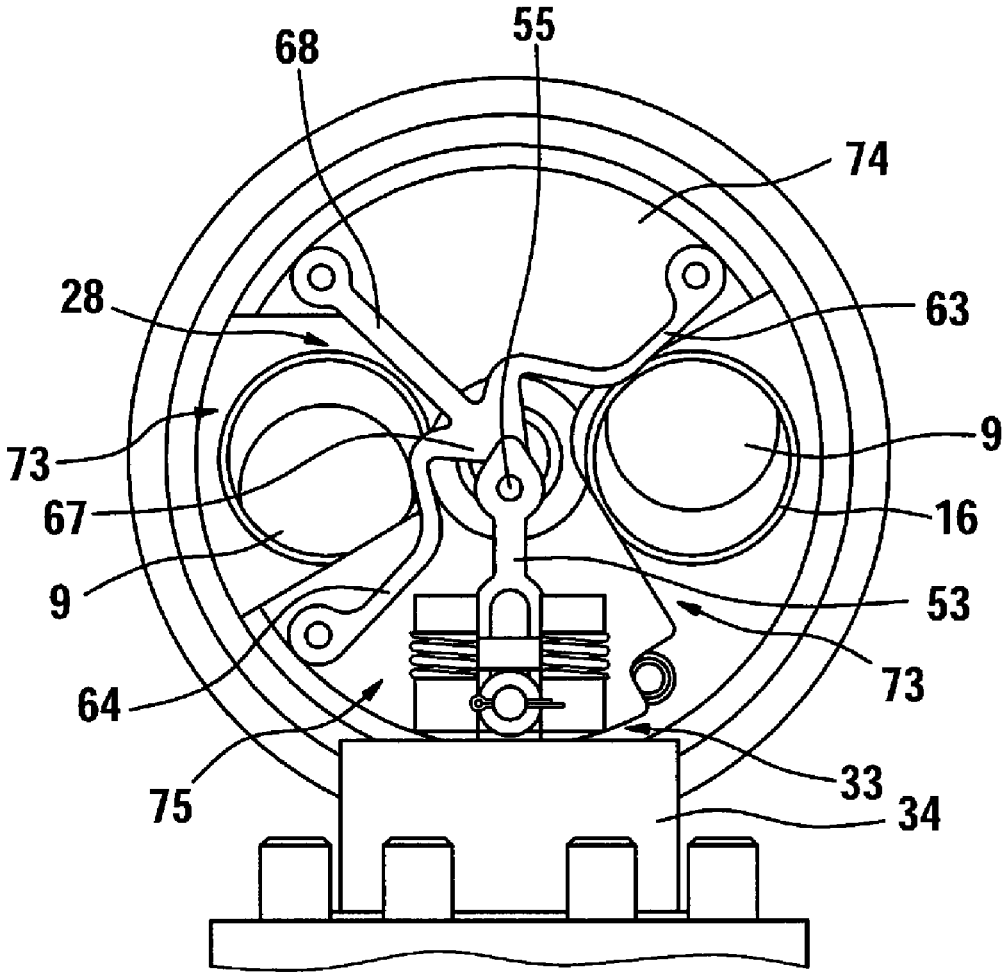

The changeover from the intermediate position according to FIG. 5*e* to the inactive position of switching apparatus 23 according to FIG. 5*f* is carried out at a pressure which is above the switching pressure. This causes piston 33 to be moved back into cylinder 34 and coil spring 39 to be compressed. Piston 33 thereby moves switching member 53 back into a starting position—as shown in FIG. 5*g*—in which it is now juxtaposed to cam arc 65 so that when piston 33 is extended the next time, switching member 53 can effect switching to "cutting". For switching member 53 to be able to reach cam arc 65 at the next switching operation, separating wall 67 (FIG. 5*h*) is extended to the front between cam arcs 65, 66, and this obstruction can be surmounted by switching member 53 at the changeover from the intermediate position according to FIG. 5*f* to that of FIG. 5*g* by a corresponding spring-loaded pivoting motion of switching member 53, when switching pin 55 travels the path along separating wall 67 to its end. Helical torsion springs 58, 59 bring back switching member 53 after its pivoting motion, back to its central and aligned position shown in FIG. 5*g*, in which switching member 53 is now juxtaposed to cam arc 65 for the next switching operation.

Based on the above description it will be seen that tool 1 shown in FIGS. 1 and 2 can be easily switched in a reliable manner from "boring" to "cutting" and vice versa by merely reducing the operating pressure to the switching pressure without manual intervention in the area of tool 1.

In FIGS. 5*h*-5*m*, the next switching operation with the corresponding intermediate positions is shown, in which the tool is switched back from "boring" to "cutting".

The invention claimed is:

1. A tool for cutting up coke, comprising a housing mounted on a rotatably driven drill stem in an operating condition, at least one cutting nozzle for cutting coke and at least one boring nozzle for boring coke in a coke drum by means of a water jet, a supply channel in the housing for supplying water flowing under high pressure through the drill stem into the housing, a valve for diverting the water being supplied through the supply channel to flow channels connected with the cutting nozzle and boring nozzle, a control apparatus being rotatable about a central longitudinal axis of the housing for controlling the valve, wherein depending on an angular position of the control apparatus a flow path of the water to the boring nozzle or a flow path to the cutting nozzle is free or obstructed, a switching apparatus for switching the tool from a cutting function to a boring function and vice versa by means of the control apparatus, and a driving apparatus for operating the switching apparatus, wherein the driving apparatus is automatically operable by a pressure storage apparatus dependent on changes of the water pressure, the changes of the water pressure being caused by reducing the water pressure from an operating pressure to a switching pressure and by raising the water pressure from the switching pressure back to the operating pressure, wherein the switching apparatus is arranged in the water flow from the supply channel and comprises a switching element for rotating the control apparatus by a desired angle, which is linearly moveable transverse to the central longitudinal axis of the housing from an inactive position to an active position by the driving apparatus when the water pressure reaches switching pressure and returnable from the active position to the inactive position when the water pressure is raised above the switching pressure, wherein the switching element is coupled with a converting apparatus for converting the linear movement of the switching element into a rotational movement of the control apparatus when the switching element engages a control member of the control apparatus for rotating the control apparatus.

2. The tool according to claim 1, wherein the control member is formed as a cam profile, with which the switching element can be brought into engagement by the driving apparatus of the switching apparatus for rotating the control apparatus.

3. The tool according to claim 2, wherein the switching element comprises a piston supported to be linearly moveable within the driving apparatus and having a switching member at its free end portion which engages the cam profile of the control apparatus for rotating the control apparatus.

4. The tool according to claim 3, wherein the driving apparatus comprises a cylinder and a piston linearly moveable within the cylinder and connected to the switching element, the piston being under the effect of a spring for pressing the piston from the inactive position to the active position, when the water is at switching pressure.

5. The tool according to claim 4, wherein the spring and the piston hold the switching member in engagement with the cam profile during switching of the control apparatus, and are pressed back into the inactive position by applying a pressure of the water above the switching pressure.

6. The tool according to claim 3, wherein the switching angle of the control apparatus is essentially 90° and the cam profile comprises two cam arcs separated by a separating wall and arranged in mirror image, wherein one is associated with switching the water flow from cutting to boring and the other is associated with switching the water flow from boring to cutting.

7. The tool according to claim 6, wherein the cam profile is formed on the sides of arms fixed to the control apparatus, which are juxtaposed to the switching member in the inactive position of the switching apparatus in such a way that the switching member is engageable with the cam profile.

8. The tool according to claim 3, wherein the switching member is pivotably supported at the free end portion of the piston and is held in a central starting position, laterally pivotable in two directions in a spring-biased manner.

9. The tool according to claim 3, wherein the movement of the piston from the inactive position to the active position is couplable with pivoting movements of the switching member after the switching member contacts the cam profile for a continuous engagement of the switching member during its relative movement on the cam profile.

10. The tool according to claim 1, wherein the control apparatus is rotatably supported on a flow body within the housing of the tool in which the flow channels of the water extend for the boring and cutting nozzles.

11. The tool according to claim 10, wherein a bearing pin is attached to the top side of the flow body, on which the control apparatus is rotatably supported with a hub member.

12. The tool according to claim 10, further comprising means for alternatively closing and exposing openings of the flow channels depending on each desired function of boring or cutting of the tool.

13. The tool according to claim 12, wherein the means comprise closure bodies for closing off the openings of the flow channels and the control apparatus comprises a guiding apparatus for displacing closure bodies for switching the water flow.

14. The tool according to claim 13, wherein the control member comprises a cam profile formed on the sides of arms mounted on the control apparatus above the guiding apparatus thereof.

15. The tool according to claim 14, wherein the arms carrying the cam profile are attached by means of supports to the guiding apparatus for moving the closure bodies.

16. The tool according to claim 15, wherein the guiding apparatus comprises along its circumference segment-shaped chambers open at the bottom for overlapping the closure bodies, as well as segment-shaped openings, and the structure and position of the arms is chosen such that the segment-shaped openings remain free for the water flow.

* * * * *